US006464077B1

(12) United States Patent
Liu

(10) Patent No.: US 6,464,077 B1
(45) Date of Patent: Oct. 15, 2002

(54) CONTAINER FOR THREAD AND WIRE

(75) Inventor: Samson Liu, Taipei Hsien (TW)

(73) Assignee: Faithful Engineering Products Co., Ltd., Taipei (TW)

( * ) Notice: Subject to any disclaimer, the term of this patent is extended or adjusted under 35 U.S.C. 154(b) by 0 days.

(21) Appl. No.: 09/900,121

(22) Filed: Jul. 6, 2001

(51) Int. Cl.[7] ..... B65D 85/00
(52) U.S. Cl. ..... 206/388; 206/409; 206/463
(58) Field of Search ..... 206/388, 389, 206/409, 461, 463, 471, 464, 806; 220/4.21; 242/586, 588.6

(56) References Cited

U.S. PATENT DOCUMENTS 4,706,843 A * 11/1987 Thornton ..... 206/388
5,133,980 A * 7/1992 Ream et al. ..... 206/409
5,875,893 A * 3/1999 Lee et al. ..... 206/388
5,878,881 A * 3/1999 Hunt ..... 206/461
6,145,722 A * 11/2000 Behrens et al. ..... 206/409
6,260,704 B1 * 7/2001 Jansen et al. ..... 206/409

* cited by examiner

*Primary Examiner*—Luan K. Bui
(74) *Attorney, Agent, or Firm*—W. Wayne Liauh

(57) ABSTRACT

A container includes a casing defining an annular chamber for a volume of thread or wire pre-wound into coils to accommodate therein without becoming tangled, and a cover detachably closed onto the casing. A clearance exists between an upper peripheral edge of the casing and a lower peripheral edge of the cover when the cover and the casing are closed, allowing a free end of the thread or wire in the annular chamber to locate outside the container via the clearance. Therefore, the thread or wire in the container could be easily accessed and pulled outward at the free end for use without the need of opening the cover. The container could be refilled with a new thread or wire and therefore could be repeatedly used.

3 Claims, 5 Drawing Sheets

CONTAINER FOR THREAD AND WIRE

BACKGROUND OF THE INVENTION

The present invention relates to a container for thread and wire. The thread or wire is wound into coils and accommodated in an annular chamber in the container with a free end of the thread or wire located outside the container, allowing the thread or wire to be easily pulled out for use without the need to open the container each time. The container could be opened to refill with new thread or wire and can therefore be repeatedly used.

To minimize the space needed for storing long thread or wire, it is a common practice to wind the thread or wire into coils and then store the same in a container, such as a poly bag. The poly bag has poor strength and does not provide a fix-shaped storing space and therefore fails to protect the coiled thread or wire stored therein. The coiled thread or wire tends to deform under pressure and causes difficulty in pulling it out for use.

To use the thread or wire stored in the poly bag, a user has to remove the whole coiled thread or wire from the bag to locate a free end of the thread or wire, and then carefully pull out a desired length of thread or wire and cut it. When the thread or wire is pulled too quickly, it is subject to a big force and tends to bend toward a center of the coils and become deformed. The deformed thread or wire produces an increased resistance to the pulling of the thread or wire and tends to become tangled that prevents the coiled thread or wire from being smoothly pulled out for use.

SUMMARY OF THE INVENTION

It is a primary object of the present invention to provide a container having sufficient strength and an annular chamber for storing a volume of coiled thread and wire, so that the coiled thread or wire in the container is always maintained in a round shape to be smoothly pulled out for use.

Another object of the present invention is to provide a container for thread and wire that allows a free end of the stored thread or wire to locate outside the container, so that the thread or wire could be easily pulled out for use at any time without the need of opening the container.

A further object of the present invention is to provide a container for thread and wire that could be refilled with new thread or wire and therefore be repeatedly used.

To achieve the above and other objects, the container for thread and wire of the present invention mainly includes a casing and a cover. The casing has a raised central cylinder, so that an annular chamber is defined in the container around the central cylinder. A volume of thread or wire pre-wound into coils is put in the annular chamber and protected against deformation. The raised central cylinder is provided at a top with a plurality of catches corresponding to a plurality of retaining holes provided on the cover. By aligning the catches with the retaining holes and turning the casing and the cover in two opposite directions, the cover are detachably closed onto the casing to enclose the thread or wire in the container. A clearance is left between an upper peripheral edge of the casing and a lower peripheral edge of the cover when the casing and the cover are closed to each other, allowing a free end of the thread or wire in the annular chamber to locate outside the container via the clearance and be easily accessed. To open the container, simply turn the cover in a reverse direction to conveniently disengage it from the casing. At this point, the container could be refilled with new thread or wire.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
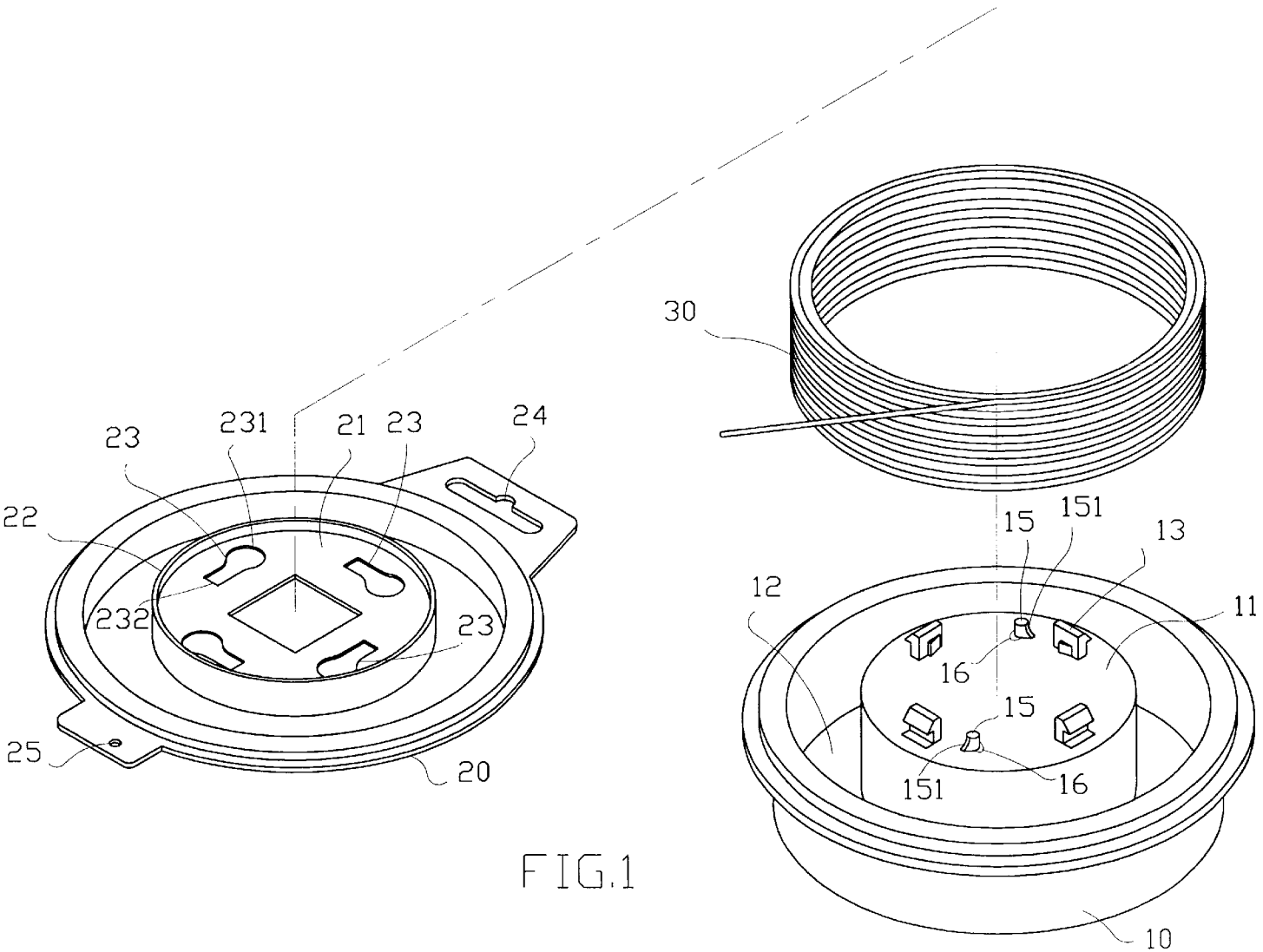
FIG. 1 is an exploded perspective view of a container for thread and wire according to the present invention.
Figure 2:
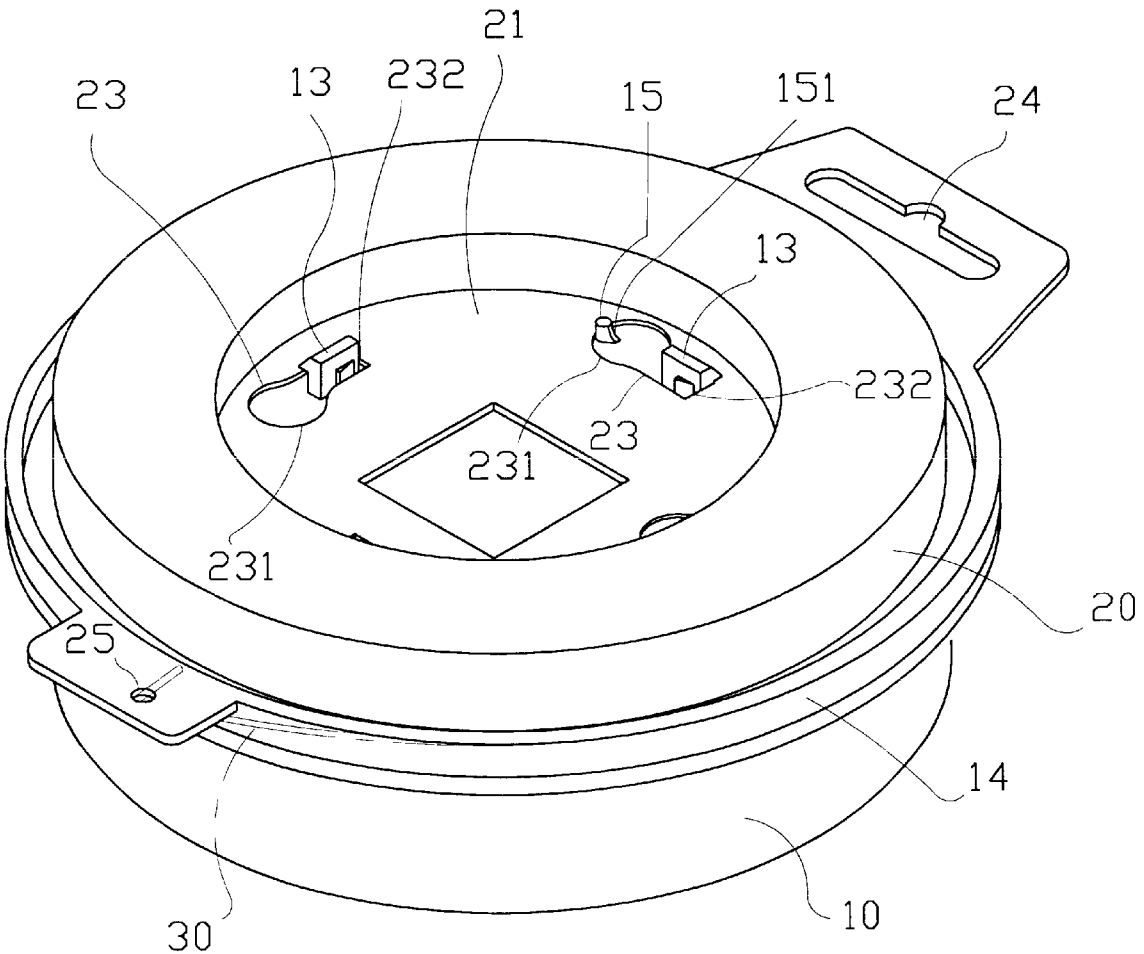
FIG. 2 is an assembled perspective view of the container of FIG. 1.
Figure 3:
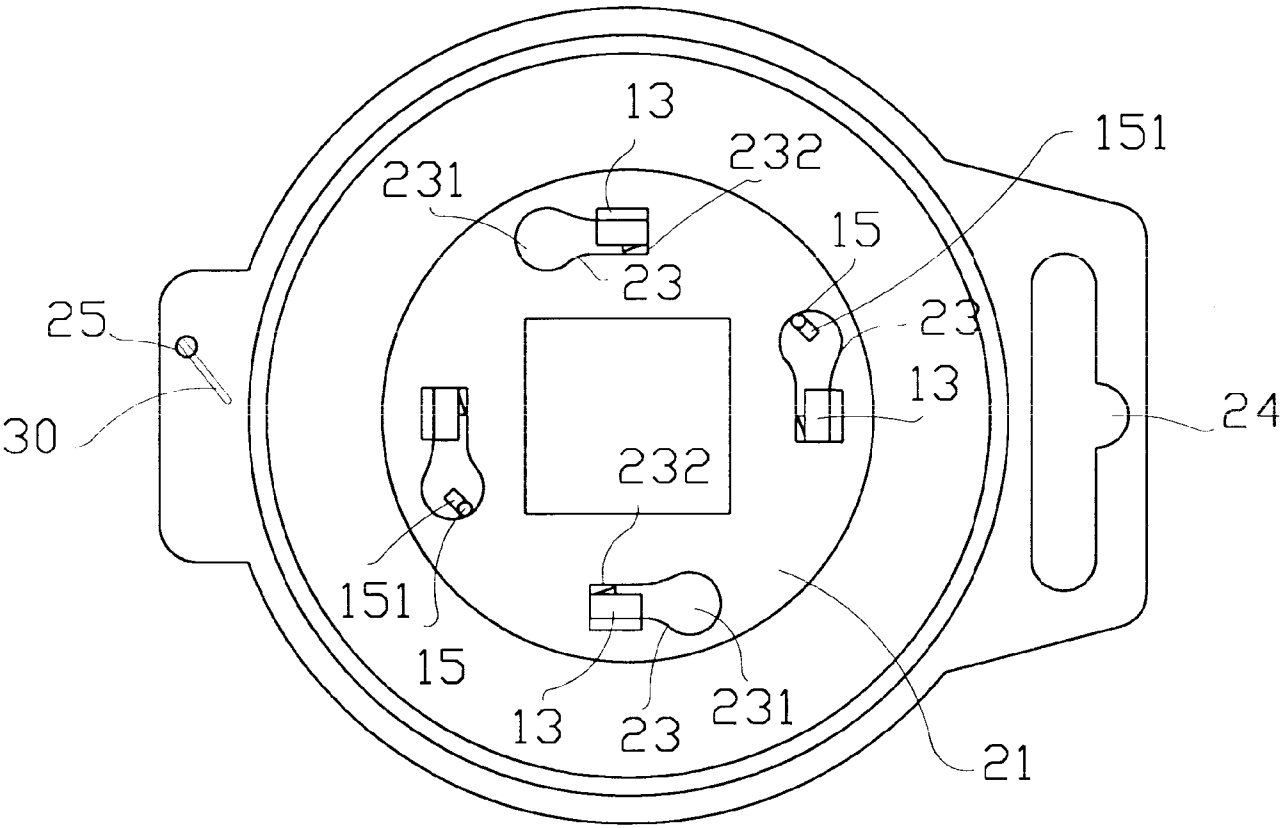
FIG. 3 is a top plan view of the container of FIG. 2.

Please refer to FIGS. 1 through 4 in which a container for thread and wire according to the present invention is shown. The container mainly includes a casing 10 and a cover 20 detachably connected to a top of the casing 10.

The casing 10 has a raised central cylinder 11, so that an annular chamber 12 is defined in the casing 10 around the central cylinder 11 and is adapted to receive a volume of thread or wire 30 that is pre-wound into coils. A plurality of catches 13 are circumferentially spaced on a top surface of the raised central cylinder 11. Two elastic retaining buttons 15 are also provided on the top surface of the central cylinder 11 to locate behind two diametrically opposite catches 13 when viewing in a rotating direction of the casing 10 relative to the cover 20 to engage the casing 10 with the cover 20. Each elastic retaining button 15 includes a front slope portion 151 downward and outward extended from top to bottom, and a rear root portion having a small recess 16. The front slope portion 151 prevents the elastic retaining button 15 from easily bending forward and becoming deformed. The rear recess 16 allows the elastic retaining button 15 to easily bend rearward and become deformed while sinks by a certain extent, as can been seen in FIG. 5.

The cover 20 has a downward extended central cylinder 21. A lower edge of the central cylinder 21 downward extends by a predetermined length to form a round wall 22. The round wall 22 has an inner diameter the same as an outer diameter of the central cylinder 11 of the casing 10, so that a top portion of the central cylinder 11 is fitly received in the round wall 22 when the cover 20 is closed onto the casing 10. A plurality of retaining holes 23 are provided on the central cylinder 21 corresponding to the catches 13 on the central cylinder 11. Each retaining hole 23 includes an expanded head portion 231 and a narrowed tail portion 232 communicable with the expanded head portion 231.

Figure 5:
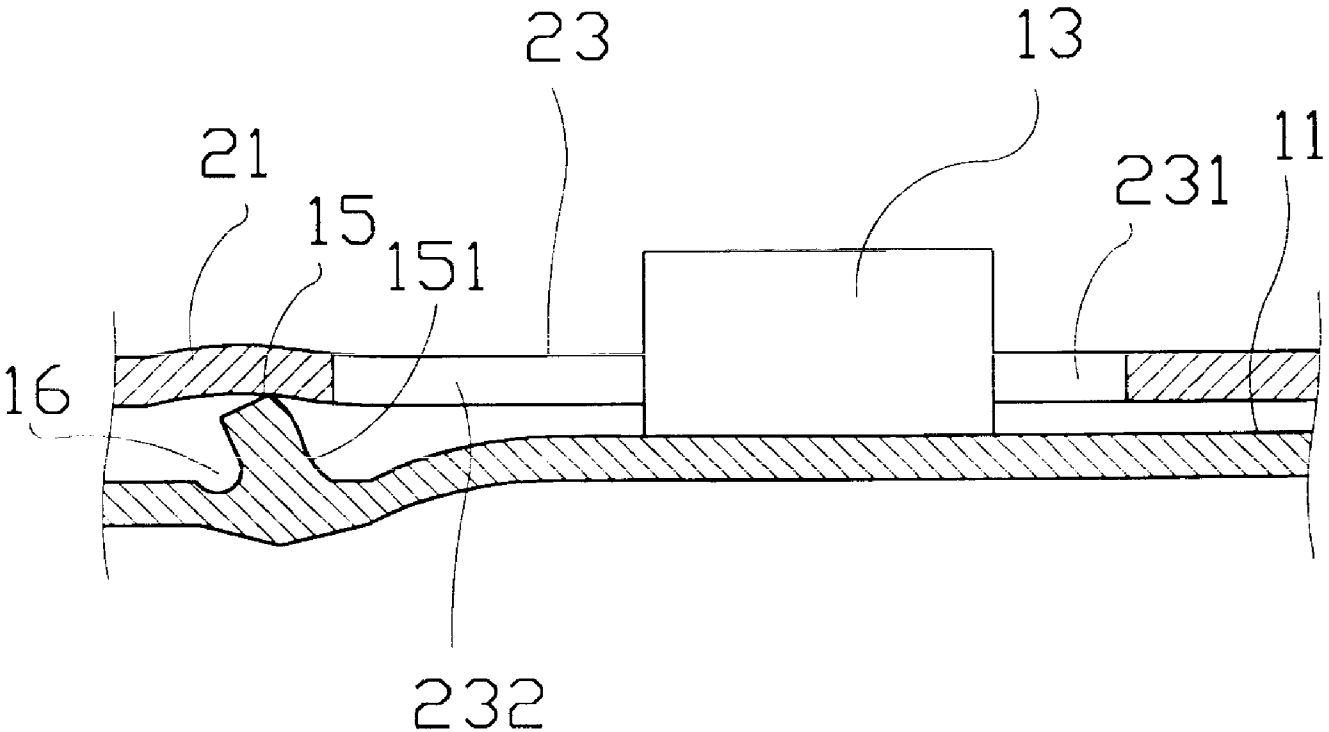
FIG. 5 is a fragmentary and enlarged sectional view of the container of FIG. 2 showing an elastic retaining button on a casing of the container is deformed under a downward pressure from a cover of the container.

The cover 20 is closed onto the casing 10 by aligning the expanded head portions 231 of the retaining holes 23 with the catches 13, so that the catches 13 upward project from the retaining holes 23, as shown in FIG. 5. At this point, the elastic retaining buttons 15 are subject to a downward pressure from a bottom of the central cylinder 21 of the cover 20 to, on the one hand, bend rearward and sink slightly due to the rear recesses 16, and on the other hand, locally push the bottom of the central cylinder 21 of the cover 20 upward. When the casing 10 is rotated relative to the cover 20, the catches 13 are moved into and engaged with the narrowed tail portions 232. At this point, the elastic retaining buttons 15 are moved into the retaining holes 23 to abut against an inner edge of the expanded head portions 231, preventing the cover 20 from turning any further and keeping the catches 13 in the narrowed tail portions of the retaining holes 23. The upward pushed bottom of the central cylinder 21 and the rearward bending and sinking of the elastic retaining buttons 15 at the rear recesses 16 enable a reduced resistance of the central cylinder 21 to the elastic retaining buttons 15 when the latter are moved into the expanded head portions of the retaining holes 23 to hold the cover 20 and the casing 10 together. Since the front slope portions 151 of the elastic retaining buttons 15 prevent the elastic retaining buttons 15 from easily bending forward and provide an increased resistance to a disengagement the cover 20 from the casing 10 by rotating the cover 20 in a direction toward the catches 13 and moving the catches 13 into the expanded head portions 231, the cover 20 is not easily detached from the casing 10 once the catches 13 have moved into the narrowed tail portions 232 and the elastic retaining buttons 15 into the expanded head portions 231.

Figure 4:
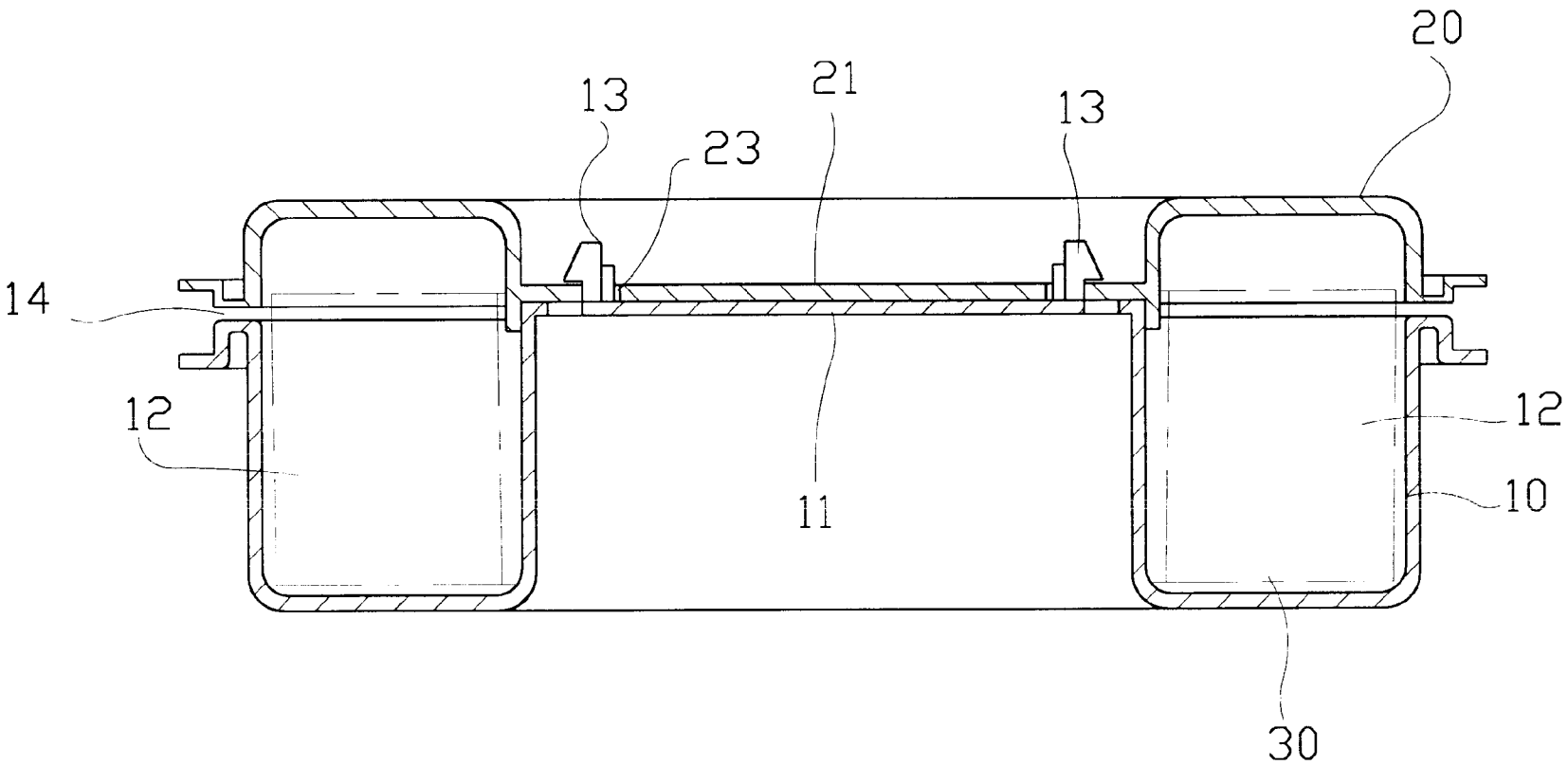
FIG. 4 is a vertical sectional view of the container of FIG. 2.

As can be seen in FIG. 4, the central cylinders 11 and 21 together form an integral central cylinder in the container of the present invention when the cover 20 is closed onto the casing 10 in the above-described manner. The thread or wire 30 wound into coils is put in the annular chamber 12 of the casing 10 around the central cylinder 11 to always maintain the coiled shape due to the integral central cylinder. An annular clearance 14 exists between an upper peripheral edge of the casing 10 and a lower peripheral edge of the cover 20 to communicate the annular chamber 12 with an outer side of the container. A free end of the thread or wire 30 is extended through the clearance 14 to locate outside the container for easy access of the thread or wire 30. A clearance, if any, at a joint of the central cylinders 11 and 21 is made very small, so that the thread or wire 30 would not be trapped therein to produce any resistance to the thread or wire 30 when the same is outward pulled from the annular chamber 12 via the clearance 14.

The casing 10 and the cover 20 may be made of a plastic material through injection molding to obtain good structural strength, lest the container should be easily deformed under a pressure and lose its ability of maintaining the thread or wire 30 in an orderly wound state. The cover 20 may be provided with a hanging hole 24 for hanging the container on a hanger fixed to a wall (not shown), and a small hole 25 for the free end of the thread or wire 30 to extend therethrough and then be bent and located in place. The bent free end of the thread or wire 30 prevents the thread or wire 30 from completely retracting into the container, so that the thread or wire 30 could be conveniently pulled for use at any time.

Since the cover 20 is detachably closed onto the casing 10, the container could be refilled with new thread or wire 30 when the old one is used up. That is, the container for thread and wire according to the present invention could be repeatedly used and is therefore an environment-friendly product.

In brief, the container of the present invention enables orderly accommodation and convenient access of the thread or wire in the container, and could be refilled with new thread or wire for use repeatedly. The container for thread and wire of the present invention is therefore industrially and commercially practical for use.

What is claimed is:

1. A container for thread and wire, comprising a casing and a cover detachably closed onto a top of said casing;

said casing having a raised first central cylinder to define an annular chamber in said casing around said first central cylinder for receiving a volume of thread or wire that is pre-wound into coils, and a plurality of catches being circumferentially spaced on a top surface of said first central cylinder; and said cover having a downward extended second central cylinder, a lower edge of said second central cylinder downward extending by a predetermined length to form a round wall, an inner diameter of which being the same as an outer diameter of said first central cylinder of said casing, so that a top portion of said first central cylinder is fitly received in said round wall when said cover is closed onto said casing; and a plurality of retaining holes being provided on said second central cylinder corresponding to said catches on said first central cylinder;

whereby when said cover is closed onto said casing with said retaining holes aligned with said catches, said cover is held to sa-id casing with a clearance existing between an upper peripheral edge of said casing and a lower peripheral edge of said cover, allowing a free end of said thread or wire in said annular chamber to locate outside said container via said clearance and be easily accessed.

2. The container for thread and wire as claimed in claim 1, wherein each of said retaining holes on said second central cylinder of said cover includes an expanded head portion and a narrowed tail portion communicable with said expanded head portion, and wherein said cover is closed onto said casing by aligning said expanded head portions with said catches on said first central cylinder and turning said cover and said casing in two opposite directions to move said catches into said narrowed tail portions.

3. The container for thread and wire as claimed in claim 2, wherein said first central cylinder of said casing is provided behind any two said catches that are diametrically opposite to each other with two elastic retaining buttons, such that when said catches are moved into said narrowed tail portions of said retaining holes on said second central cylinder, said elastic retaining buttons are located in two of said expanded head portions to abut against an inner edge thereof, and thereby prevent said cover from easily rotating relative to said casing and restrict said catches to said narrowed tail portions of said retaining holes to hold said cover to said casing.

* * * * *